US006990692B1

(12) United States Patent
Park

(10) Patent No.: US 6,990,692 B1
(45) **Date of Patent: *Jan. 31, 2006**

(54) CAP WITH CURVED VISOR

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/511,492

(22) Filed: Feb. 23, 2000

(51) Int. Cl.
*A42B 1/00* (2006.01)

(52) U.S. Cl. ..... 2/195.6; 2/175.5; 2/209.12

(58) Field of Classification Search ..... 2/12, 2/175.2–175.5, 195.7, 195.6, 209.12
See application file for complete search history.

(56) References Cited

U.S. PATENT DOCUMENTS

| | | | | | |
|---|---|---|---|---|---|
| 4,106,119 | A | | 8/1978 | Taupin | 2/12 |
| 4,549,316 | A | | 10/1985 | Johnson | 2/195 |
| 4,682,373 | A | | 7/1987 | Baran | 2/175 |
| 4,839,924 | A | | 6/1989 | Laurence | 2/10 |
| 5,054,123 | A | * | 10/1991 | Helms | 2/12 |
| 5,450,629 | A | * | 9/1995 | Gilstrap | 2/209.11 |
| 5,487,191 | A | * | 1/1996 | Ridley | 2/195.1 |
| 5,621,915 | A | * | 4/1997 | Schneider et al. | 2/10 |
| 5,754,983 | A | | 5/1998 | Landers | 2/195 |
| 5,781,933 | A | * | 7/1998 | De Giacomi | 2/195.1 |
| 5,845,339 | A | | 12/1998 | Ashley et al. | 2/195 |
| 5,862,522 | A | | 1/1999 | Cho | 2/195 |
| 5,901,371 | A | | 5/1999 | Lee | 2/10 |
| 6,311,331 | B1 | * | 11/2001 | Park | 2/195.1 |
| 6,735,782 | B2 | * | 5/2004 | Park | 2/175.5 |

* cited by examiner

*Primary Examiner*—Tony M. Argenbright
(74) *Attorney, Agent, or Firm*—Mayer, Brown, Rowe & Maw LLP

(57) ABSTRACT

A cap with a curved visor includes a crown formed of a plurality of panels and a visor consisted of a rigid material and inner and outer fabric panels, which covers the rigid material. The visor is secured to a front side of the crown. At least one incision line is made on the rigid material thereby creating a main portion and a strip portion, the main portion is inserted below the strip portion to retain the visor curved. The panels of crown are made out of a common woven fabric material or a stretchable fabric material. The rigid material is a flexible rigid material or a non-flexible rigid material. At least one incision line is made on the rigid material in equal distance from an outer edge of the rigid material along a periphery of the rigid material.

10 Claims, 5 Drawing Sheets

CAP WITH CURVED VISOR

BACKGROUND OF THE INVENTION

1. Field of the Invention

The present invention relates generally to a cap having a curved visor, and more particularly, to a cap having a visor embedding a rigid material, on which at least one incision line, a groove or an indent is formed, such that the visor may maintain its curved shape and have diminished pressure to the head when worn.

2. Description of the Prior Art

Hats have been used for a variety of purpose and are in many shapes and sizes. One of the most popular hats is a baseball-style cap. The baseball-style cap typically includes a crown formed of a plurality of panels and a visor, which is extended from the front side of the crown. The visor is typically made of a rigid material having flat or curved configuration. In order to more effectively block the sun light, the visor is shaped into a curved configuration by applying predetermined degree of heat to a rigid flat sheet material, which is embedded in the visor. However, the visor tends to revert to its original flat shape and loses its curved shape over time. Also, when attempting to store or carry a cap in a pocket, it is difficult to keep the visor placed in the pocket. Sometimes, it may damage or transform the shape of the visor.

In order to solve the problem set forth above, a method of stitching the center of the visor is proposed. That is, the center of the visor is stitched to allow the visor to be folded along the center of the stitched line to reduce the overall size of the cap.

Another method is described in the U.S. Pat. No. 5,450,629 issued to Gilstrap in 1995. This patent introduces a hat where the visor is constructed to be folded like an accordion such that once the visor is folded, the hat is readily inserted into a pocket inside a shell of the hat, making the hat conveniently storable and portable.

However, the above mentioned methods are only partially effective in reducing the overall size of the hat by simple folding the visor. Whereas, the present invention provides a cap that is reducible in size while improving the aesthetic value of the hat and more effectively blocking the sun light.

SUMMARY OF THE INVENTION

Therefore, it is a primary object of the present invention to provide an improved baseball-style cap including a curved visor that is reducible in size and more effective in blocking the sun light.

It is another object of the present invention to provide a baseball-style cap which is conveniently storable and portable.

It is another object of the present invention to provide a cap with a curved visor, wherein the visor retains its curved shape over time.

It is another object of the present invention to provide a cap with a curved visor which is foldable, yet folding of the cap does not damage or transform the shape of the visor.

It is another object of the present invention to provide a cap with a curved visor, which has a different fabric with different color scheme to accentuate a strip portion at the periphery of the visor to increase the overall aesthetic value of the cap.

It is another object of the present invention to provide a cap with a curved visor, which has increased flexibility for diminished pressure to the head when worn.

It is another object of the present invention to provide a cap with a curved visor, which has creases on the visor so that the creases fade more through repeated washing than the surrounding flat portion on the outer fabric panel and it is more fashionable.

In order to achieve the foregoing objects, the present invention provides a cap with a curved visor, which includes a crown formed of a plurality of panels and a visor consisted of a rigid material and inner and outer fabric panels, which covers the rigid material. The visor is secured to a front side of the crown. Wherein at least one incision line is made on the rigid material thereby creating a main portion and a strip portion, the main portion is inserted below the strip portion to retain the visor curved.

In order to achieve the foregoing objects, the present invention provides a cap with a curved visor, which includes a crown formed of a plurality of panels and a visor consisted of a rigid material having at least one groove and inner and outer fabric panels, which cover the rigid material. The visor is secured to a front side of the crown. Wherein the rigid material having at least one groove is curved depending on a desired angle and embedded within the inner and outer fabric panels to retain the visor curved.

In order to achieve the foregoing objects, the present invention provides a cap with a curved visor, which includes a crown formed of a plurality of panels and a visor consisted of a rigid material having at least one groove and inner and outer fabric panels, which cover the rigid material. The visor is secured to a front side of the crown. Wherein the rigid material is partially cut to create at least one indent across the rigid material to create a curve on said visor.

BRIEF DESCRIPTION OF THE DRAWINGS

FIG. 1-1 is a fragmentary sectional view of the visor taken along the line A–A' of FIG. 1.

FIG. 2-1 is a perspective view of the rigid material according to the first preferred embodiment of the present invention.

FIG. 2-2 is a perspective view of the visor embedding the rigid material according to the first preferred embodiment of the present invention.

FIG. 7-1 is an enlarged fragmentary sectional view of part B of FIG. 7.

FIG. 9-1 is an enlarged fragmentary sectional view of line C–C' of FIG. 9.

DETAILED DESCRIPTION OF THE PREFERRED EMBODIMENTS

Figure 1:
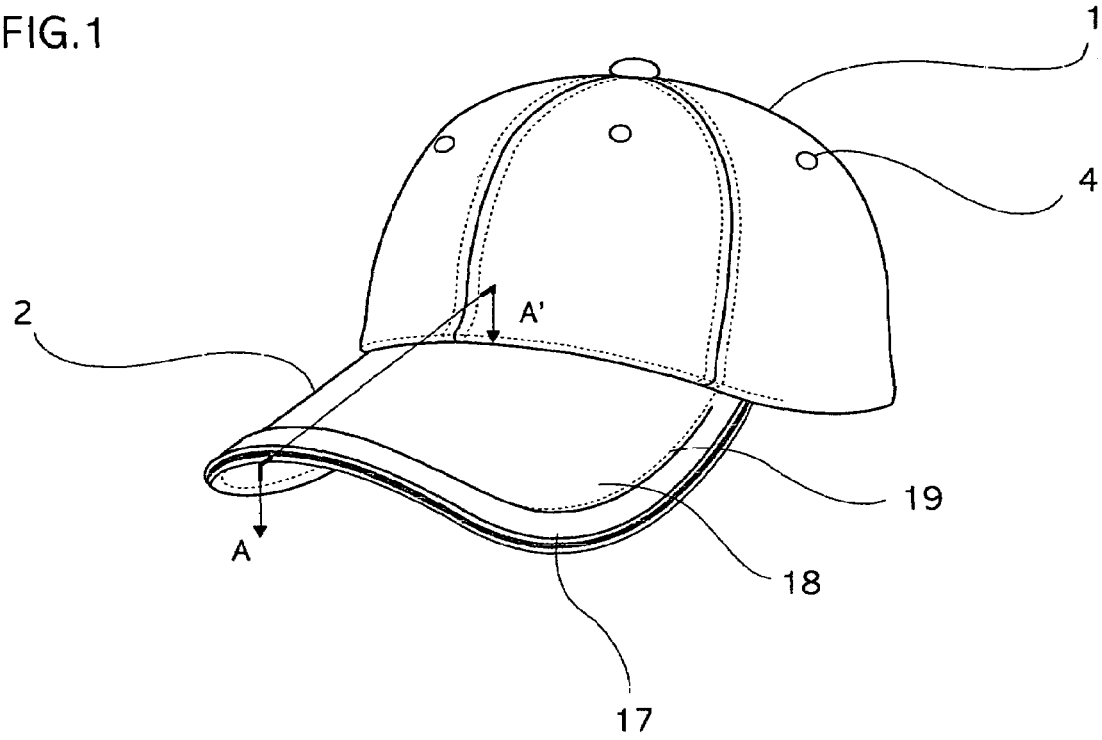
FIG. 1 is a perspective view of a cap with a curved visor according to a first preferred embodiment of the present invention.
Figure 1:
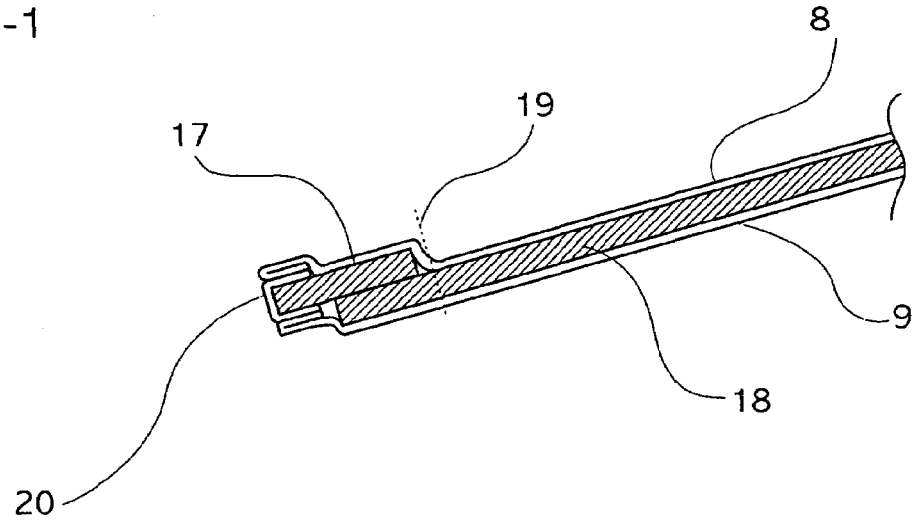

In accordance with the first preferred embodiment of the present invention, and with reference to FIG. 1 and FIG. 1-1, a cap is consisted of a crown 1 and a visor 2. The crown 1 is formed of a plurality of fabric panels. Each fabric panel has an eyelet 4. The visor 2 is secured to the front side of the crown 1. The crown 1 is typically made out of woven fabric or stretchable fabric material.

According to this embodiment, an incision in the rigid material in the visor 2 is made in equal distance from the edge 11 of the visor 2 along periphery of the rigid material 10 up to a certain portion of the rigid material 10 thereby creating a strip portion 17 along the edge 10 of the rigid material 10 and a main portion 18. The incision line is shown with the reference number 21 in FIG. 2.

Then, the main portion 18 is inserted below the strip portion 17. A stitch line 19 is created on the overlapping section of the two portions so that the main portion 18 of the rigid material inserted under the strip portion 17 retains its curve allowing the visor 2 to keep its curved shape. A different fabric with different color scheme may also be used to accentuate the strip portion 17 to increases the overall aesthetic value of the cap.

Figure 2:
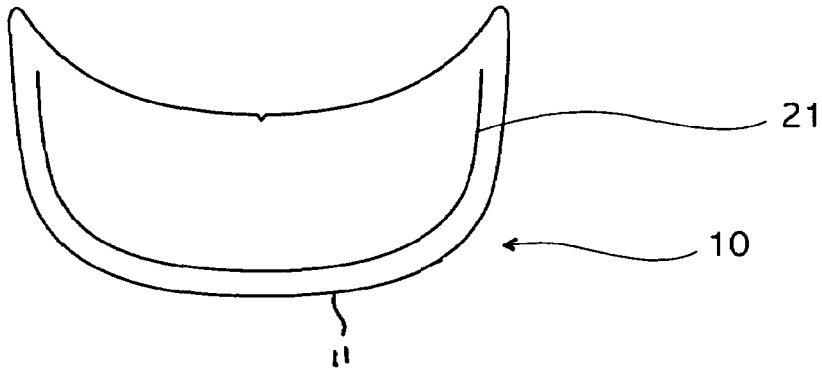
FIG. 2 is a top plan view of a rigid material according to the first preferred embodiment of the present invention.
Figures 1, 2:
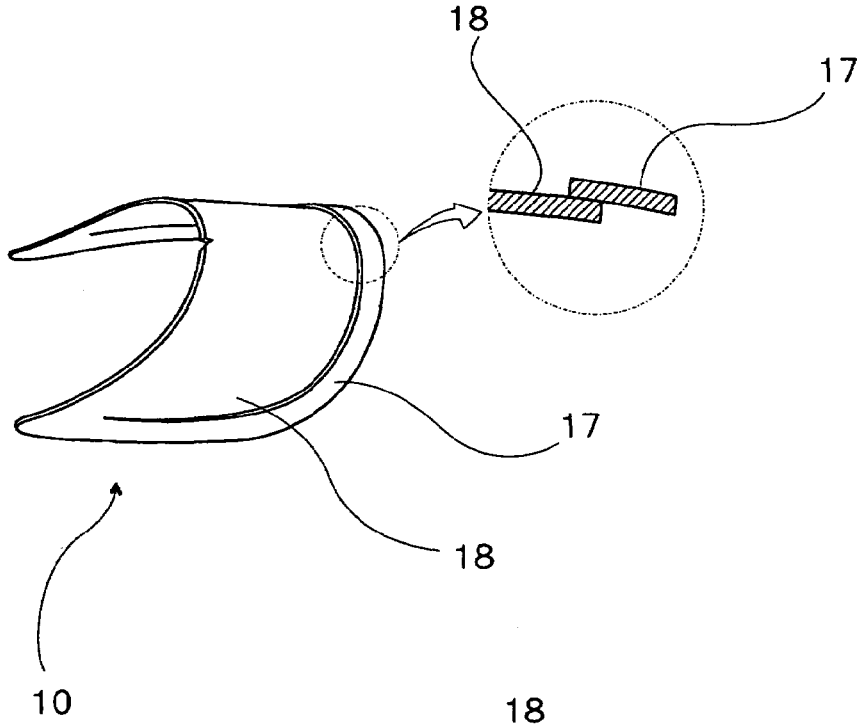
Figure 2:
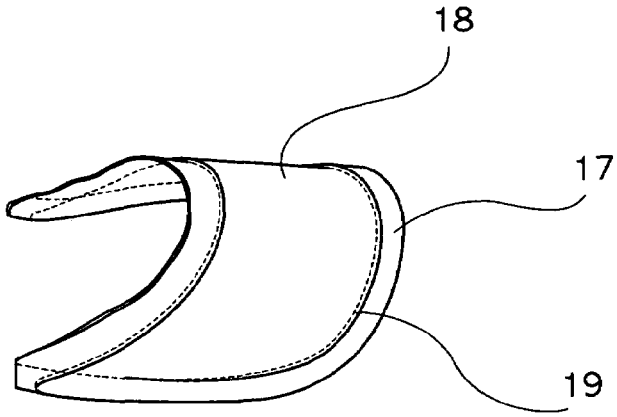

FIG. 2-1 is a perspective view of the rigid material 10. As shown in the drawing, the main portion 18 of the rigid material is inserted below the strip portion 17.

FIG. 2-2 is a perspective view of the visor 2 which incorporates the rigid visor material 10 according to the first embodiment, which is retaining the curved shape.

Figure 3:
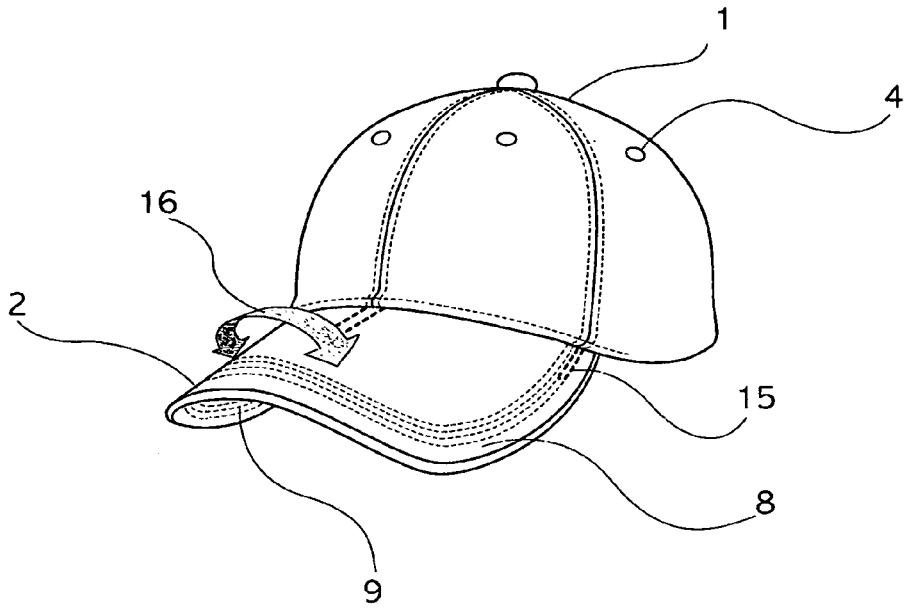
FIG. 3 is a perspective view of a cap with grooves in the rigid material according to a second preferred embodiment of the present invention.
Figure 4:
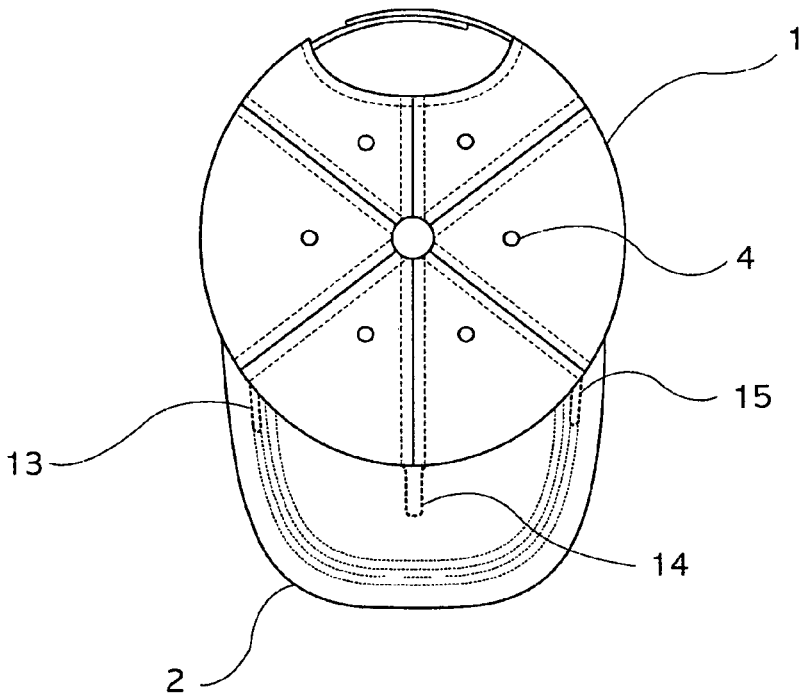
FIG. 4 is a top plan view of a cap of the present invention with grooves in the rigid material according to the second preferred embodiment of the present invention.

The second preferred embodiment of the present invention is illustrated with reference to FIGS. 3–5. In this embodiment, referring FIGS. 3–4, the visor 2 is consisted of an outer fabric panel 8, an inner fabric panel 9 and a rigid material 10 embedded within the fabric panels 8, 9. Grooves 13, 15 are respectively made at the ends of the rigid material 10 and groove 14 is made at the center of the rigid material 10.

The curve shaped visor 2 having the rigid material 10, on which grooves 13, 14, 15 are made, is then secured to the front side of the crown 1. The grooves 13, 14, 15 prevent the visor 2 from reverting to the original flat shape by reducing the tension, such that the curved shape 16 is maintained longer compared to a conventional visor due to the evenly distributed elasticity. The end portions of the visor 2 have increased flexibility for diminished pressure to the head when worn.

Figure 5:
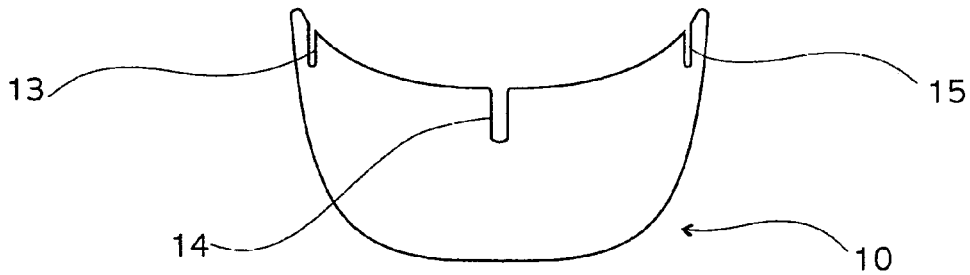
FIG. 5 is a top plan view of the rigid material with cut grooves according to the second preferred embodiment of the present invention

FIG. 5 is a top plan view of the rigid material 10 with grooves 13, 14, 15. As shown in the drawing, the size of the grooves 13, 14, 15 are predetermined to achieve the result. The place where the grooves are made and the number of grooves on the rigid material 10 may vary depending on the desired angle of the curve on the visor 2. In this invention, for illustrative purpose, two side grooves and a center groove are described.

Figure 6:
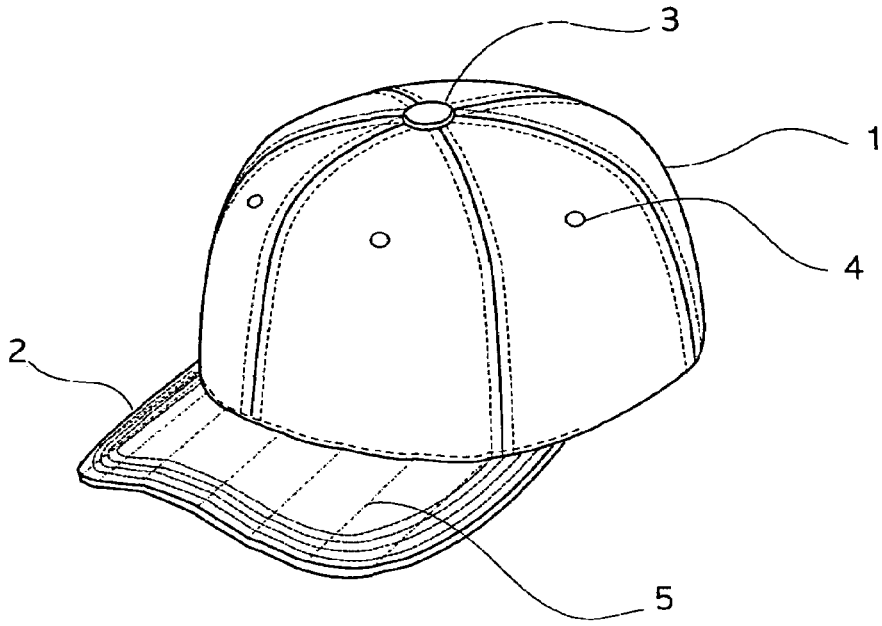
FIG. 6 is a perspective view of a cap with creases formed on the visor according to a third preferred embodiment of the present invention.
Figure 7:
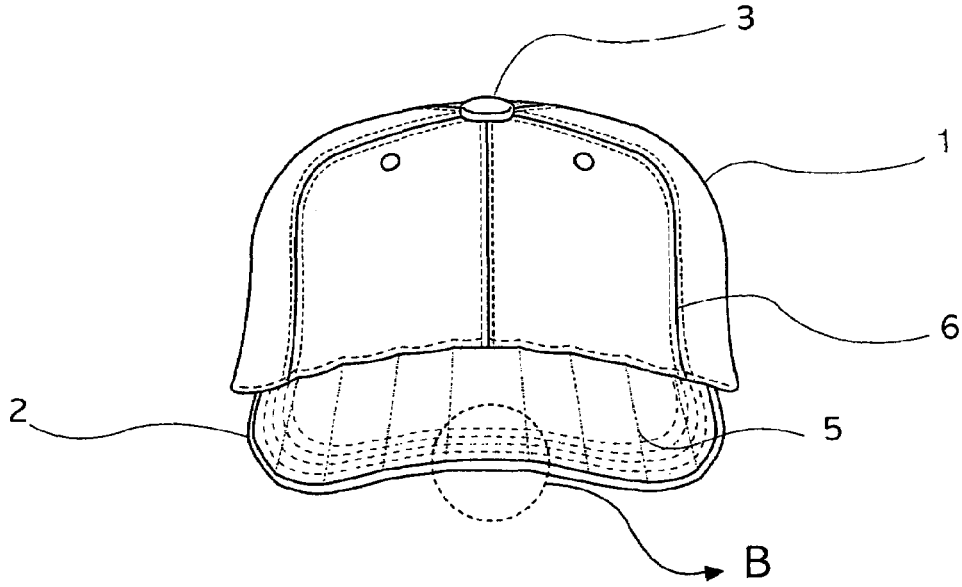
FIG. 7 is a front elevational view of a cap of the present invention with creases formed on the visor.
Figures 1, 7:
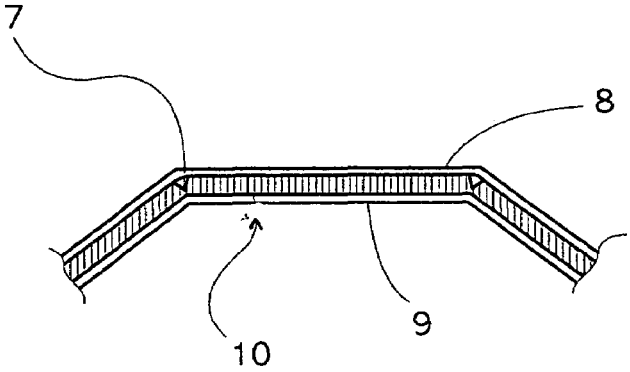

The third preferred embodiment of the present invention is illustrated with reference to FIG. 6 to FIG. 9-1. Referring to FIG. 6 and FIG. 7, each fabric panel of crown 1 is attached at the seam 6 and held together by a top button 3 and double stitch lines are sewn by the seam 6. A visor 2 is secured to a front side of the crown 1. The rigid material 10 is partially cut to create indents 7 across the rigid material 10, which in effect creates and maintains a curve on the visor 2. After the outer and inner fabric panels are covered and stitched onto the rigid material 10, creases 5 are formed on the outer fabric panel 8 in equal number to the indents 7 made on the rigid material 10.

For illustration purpose, eight creases are formed in FIGS. 6–7 to show an example of the present invention. The depth of the incision, the number of the indents 7 and the distance between the indents 7 may vary depending on the desired angle of the curve on the visor 2. A cap including the foldable visor of this embodiment provides an increased protection from the sun compared to the conventional visors and is more fashionable. When storing or carrying the cap, a damage to the visor can be avoided by folding the visor 2 along the creases 5, and the overall size of the cap can be reduced by folding the flexible crown 1 appropriately.

According to this embodiment of the present invention, the creases 5 on the visor 2 will fade more through repeated washing than the surrounding flat portion of the outer fabric panel 8 and it will be more fashionable.

FIG. 7-1 illustrates an enlarged fragmentary sectional view of part B of FIG. 7. As shown in the drawing, the indents 7 are provided in the rigid material 10. The rigid material 10 is covered by the outer fabric panel 8 and the inner fabric panel 9, which are jointly stitched together at the periphery.

Figure 8:
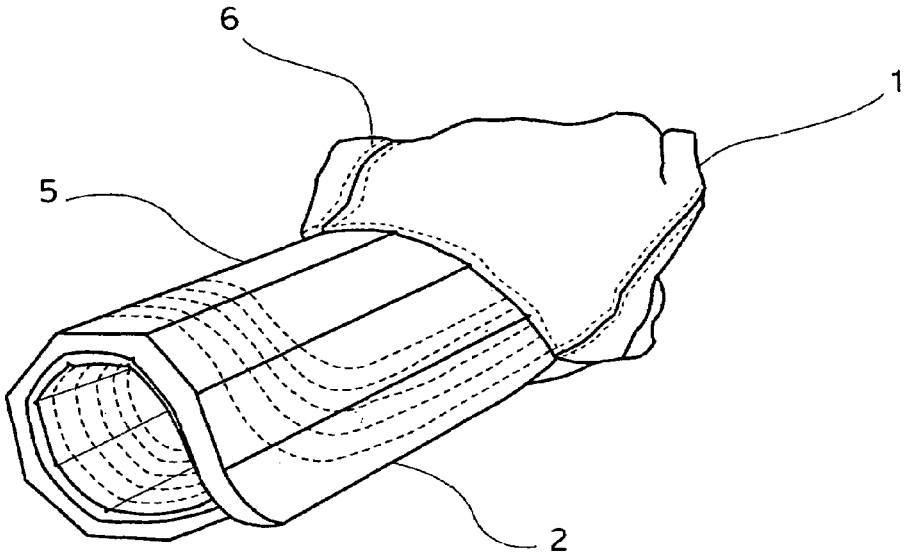
FIG. 8 is a perspective view of a cap of the present invention with the visor folded along the creases according to the third preferred embodiment of the present invention.
Figure 9:
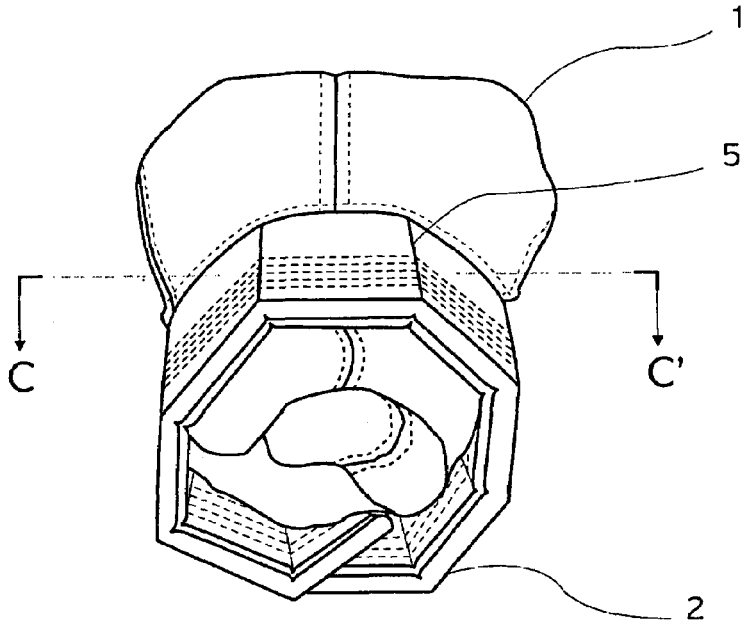
FIG. 9 is a front elevational view of a cap of the present invention with the visor folded along the creases.
Figures 1, 9:
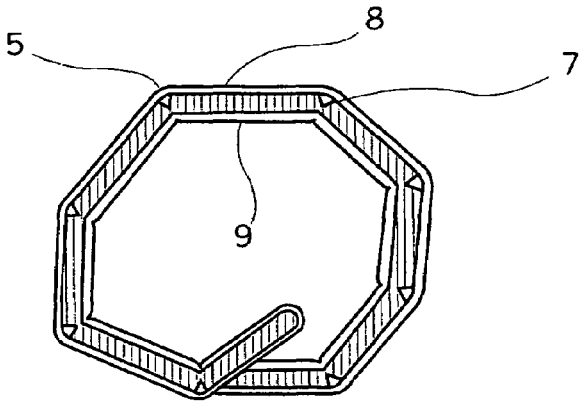

FIG. 8 and FIG. 9 illustrate a cap folded along the creases 5 and reduced in size, while the crown 1 is also folded. Such folding of the cap makes it easier to store and carry.

FIG. 9-1 is a fragmentary sectional view of line C–C' of FIG. 9 to illustrate the reduction of the size of the cap. The rigid material 10 is easily folded along the creases 5 without damage to the shape of the cap.

It will be apparent to those skilled in the art that various modifications and variations can be made in the cap of the present invention without departing from the spirit or scope of the invention. Thus, it is intended that the present invention cover the modifications and variations of this invention provided they come within the scope of the appended claims and their equivalents.

What is claimed is:

1. A cap with a curved visor, comprising:

a crown formed of a plurality of panels; and a visor consisted of a rigid material and inner and outer fabric panels, which covers the rigid material, said visor being secured to a front side of said crown;

wherein at least one incision line is made on the rigid material thereby creating a main portion and a strip portion, the main portion is inserted below the strip portion to retain said visor curved.

2. The cap with a curved visor of claim 1, wherein the panels of crown are made out of a common woven fabric material.

3. The cap with a curved visor of claim 1, wherein the panels are made out of a stretchable fabric material.

4. The cap with a curved visor of claim 1, wherein the rigid material is a flexible rigid material.

5. The cap with a curved visor of claim 1, wherein the rigid material is a non-flexible rigid material.

6. The cap with a curved visor of claim 1, wherein the at least one incision line is made on the rigid material in equal distance from an outer edge of the rigid material along a periphery of the rigid material.

7. The cap with a curved visor of claim 6, wherein more than two incision lines are made, each line is made in equal distance form an outer edge of the rigid material along a periphery of the rigid edge.

8. The cap with a curved visor of claim 1, wherein the rigid material is covered by the outer panel and the inner panel which are jointly stitched together at a periphery.

9. The cap with a curved visor of claim 1, wherein a periphery of the visor is covered with different color of fabric and stitched together with the outer and inner panels.

10. The cap with a curved visor of claim 1, a stitch line is created on an overlapping portion of the main portion and the strip portion in order to secure curve of said visor.

* * * * *